United States Patent [19]

Widmyer

[11] 4,452,309

[45] Jun. 5, 1984

[54] METHOD AND MEANS FOR UNIFORMLY DISTRIBUTING BOTH PHASES OF STEAM ON THE WALLS OF A WELL

[75] Inventor: Richard H. Widmyer, Houston, Tex.

[73] Assignee: Texaco Inc., White Plains, N.Y.

[21] Appl. No.: 416,796

[22] Filed: Sep. 13, 1982

[51] Int. Cl.[3] ..... E21B 43/24; E21B 36/02

[52] U.S. Cl. ..... 166/303; 166/59

[58] Field of Search ..... 166/59, 303, 302, 272, 166/260, 261

[56] References Cited

U.S. PATENT DOCUMENTS

| | | | |
|---|---|---|---|
| 2,506,853 | 5/1950 | Berg et al. | 166/59 X |
| 3,272,262 | 9/1966 | Hujsak | 166/59 X |
| 3,372,754 | 3/1968 | McDonald | 166/59 |
| 3,456,721 | 7/1969 | Smith | 166/59 |
| 4,136,737 | 1/1979 | Howard et al. | 166/251 |
| 4,137,968 | 2/1979 | Howard et al. | 166/53 |
| 4,336,839 | 6/1982 | Wagner et al. | 166/59 |
| 4,366,860 | 1/1983 | Donaldson et al. | 166/59 |
| 4,385,661 | 5/1983 | Fox | 166/59 |

*Primary Examiner*—Stephen J. Novosad

*Attorney, Agent, or Firm*—Robert A. Kulason; Jack H. Park; Theron H. Nichols

[57] ABSTRACT

A method comprises (1) piping of exhaust steam flow from a down hole steam generator positioned at the top of a petroliferous reservoir down to the bottom of the reservoir, and (2) reversing the direction of hot exhaust steam flow to saturate the complete petroliferous reservoir wall surface with the steam of uniform quality, the steam having uniformity of distribution of both liquid and vaporous phases for improved enhanced oil recovery. A new steam generator is also disclosed.

4 Claims, 5 Drawing Figures

METHOD AND MEANS FOR UNIFORMLY DISTRIBUTING BOTH PHASES OF STEAM ON THE WALLS OF A WELL

BACKGROUND OF THE INVENTION

Improvements in oil recovery are necessary to satisfy the present and future energy requirements of the United States and other countries of the world. As primary production of oil wells becomes exhausted, secondary or enhanced recovery becomes necessary to continue oil production. Steam injection is one of the most popular means of enhanced recovery of the present time.

The conventional method of use of steam is to generate it at the surface or above the ground and pump it down to the oil formation or subterranean petroliferous reservoir. However, because the steam rapidly loses heat and quality as it travels down the wellbore, this method is very wasteful of energy, particularly in that the greater the depth, the greater the loss of heat from the steam prior to reaching the petroliferous reservoir. Efficiencies up to 97% can be obtained by injecting the hot exhaust gases and steam into the oil reservoir with the down hole steam generator as compared to conventional surface steam generator efficiencies of 40–50%. This shows energy savings due to the fact that less fuel is required per unit of heat injected into the reservoir. Also, much of the heat generated in the conventional surface steam generator is lost to the atmosphere along with pollutants, out of the stack. Down hole steam generators may consume only 60% of the fuel volume for the same heating effect in the reservoir as compared to surface steam generators. Also there is a loss of efficiency in terms of oil recovery per unit of steam generated. Thus, a new method and a new steam generator for carrying out the method have been invented for generating the steam down hole near the oil formation. Accordingly, with this method and steam generator, depth of the well hole now makes little difference, if any, on the efficiency of the enhanced recovery.

For practical purposes, steam having a quality of 80% and thus having both a liquid phase and a vapor phase is preferred for being injected into a well. However, when these two phases of steam are injected down into a well in a subterranean petroliferous reservoir directly from the exit of the burner for enhanced oil recovery, which is now conventional, the heavier liquid phase has a tendency and inertia to continue straight down the well until it hits the bottom before being reflected towards the sides of the well where it then contacts the oil bearing or petroliferous formation, while the vapor phase tends to contact the sides of the well immediately and passes down the sides until it contacts the up coming liquid phase. The resultant effect is that the liquid phase mostly enters the bottom of the formation and the vapor phase mostly enters the upper portion of the formation with a resultant inefficient placement of non-uniform heat content fluids across the formation face. The new disclosed down hole steam generator subjects the complete well wall to both phases of the steam simultaneously for increased efficiency and oil production.

OBJECTS OF THE INVENTION

Accordingly, a primary object of this invention is to provide a method for contacting all of the well injection interval with both liquid and vapor phases of uniform quality steam when injected down into a well for improved oil recovery.

Another primary object of this invention is to provide a down hole steam generator having a pipe means on the exhaust end of the steam generator for extending down for the full thickness of the petroliferous reservoir and a flow reversing means on the lower end of the pipe means for ejecting all of the steam up over all of the petroliferous reservoir wall surface for increased oil production.

A further object of this invention is to provide a few methods and a mechanism for generating steam down hole in a well wherein both methods and mechanism are easy to operate. The steam generator is of simple configuration and is economial to build and assemble and, both steam generator and methods having greater efficiency for the generation of steam down hole for enhanced recovery.

Other objects and various advantages of the disclosed methods and steam generator will be apparent from the following detailed description, together with the accompanying drawings, submitted for purposes of illustration only and not intended to define the scope of the invention, reference being made for that purpose to the subjoined claims.

SUMMARY OF THE INVENTION

Now it has been discovered that these and other objects may be accomplished by the methods and steam generators of the invention. The basic method comprises the steps of (1) piping the hot steam flow from a steam generator positioned in a well at the top of a petroliferous reservoir down to the bottom of the petroliferous reservoir, and (2) reversing the direction of the hot steam flow with a fluid flow reverser to saturate the reservoir well wall surface back up from the bottom of the reservoir to the top of the reservoir with steam of uniform quality, the steam thus having improved uniformity of both liquid and vaporous phases against the reservoir well wall surface for improved enhanced oil recovery.

The basic new down hole steam generator comprises a steam generator adapted to be positioned in a well at the top of the petroliferous reservoir, an elongated exhaust pipe extending down from the steam generator having a length equal to substantially the thickness of the petroliferous reservoir and a fluid flow reverser and mixer means on or at the bottom of the elongated pipe for reversing the direction and flow of the hot steam flow and products of combustion from the bottom of the reservoir to the top of the reservoir with steam of uniform quality and distribution up the annulus formed between the well wall surface and the elongated pipe. Likewise, both liquid and vapor phases of the steam are well mixed simultaneously with the sudden 180° reversing of the steam flow path to help provide the uniformity of both quality of the steam and distribution of both the liquid and vaporous phases of the steam for improved enhanced oil recovery.

BRIEF DESCRIPTION OF THE DRAWINGS

The drawings diagrammatically illustrate by way of example, not by way of limitation, one form of the invention wherein like reference numerals designate corresponding parts in several views in which.

The invention disclosed herein, the scope of which being defined in the appended claims is not limited in its application to the details of construction and arrangement of parts shown and described, since the invention is capable of being in the form of other embodiments and of being practiced or carried out in various other ways. Also, it is to be understood that the phraseology or terminology employed here is for the purpose of description and not of limitation. Further, many modifications and variations of the invention as hereinafter set forth will occur to those skilled in the art. Therefore, all such modifications and variations which are within the spirit and scope of the invention herein are included and only such limitations should be imposed as are indicated in the appended claims.

DESCRIPTION OF THE INVENTION

Two related embodiments of my invention are disclosed herein, a method of injecting steam down hole in a well for providing uniformity of distribution of both liquid and vaporous phases of the steam for improved enhanced oil recovery and a new steam generator.

METHOD OF STREAM INJECTION FOR IMPROVED ENHANCED OIL RECOVERY

Figure 1:
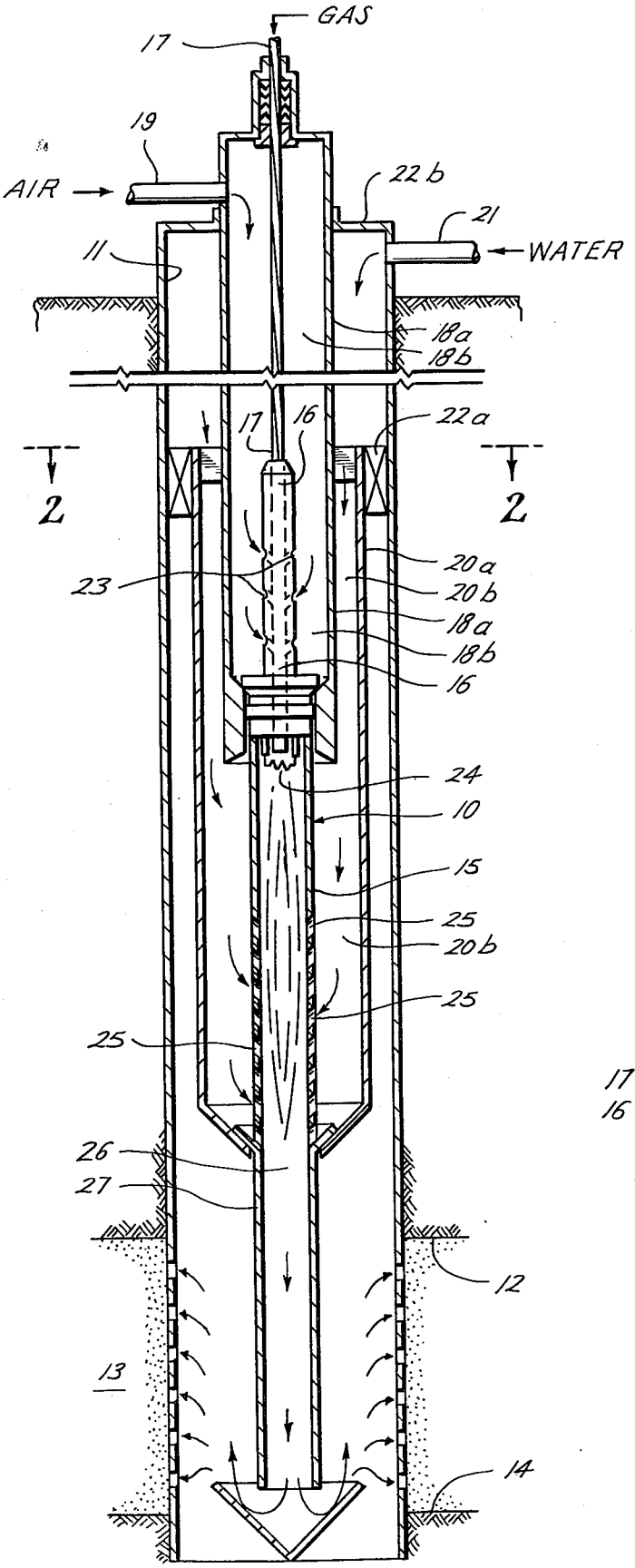
FIG. 1 is a schematic diagrammatic vertical sectional view of the down hole steam generator for recovery of petroleum from a well in a subterranean petroliferous reservoir in enhanced oil recovery.
Figure 2:
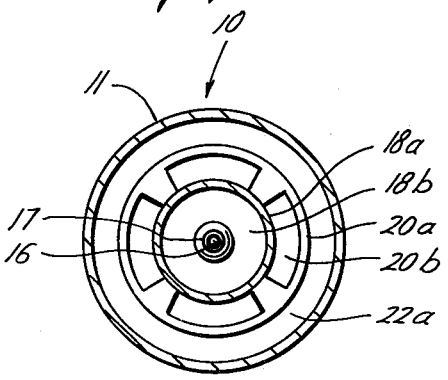
FIG. 2 is a sectional view at 2—2 on FIG. 1.
Figure 3:
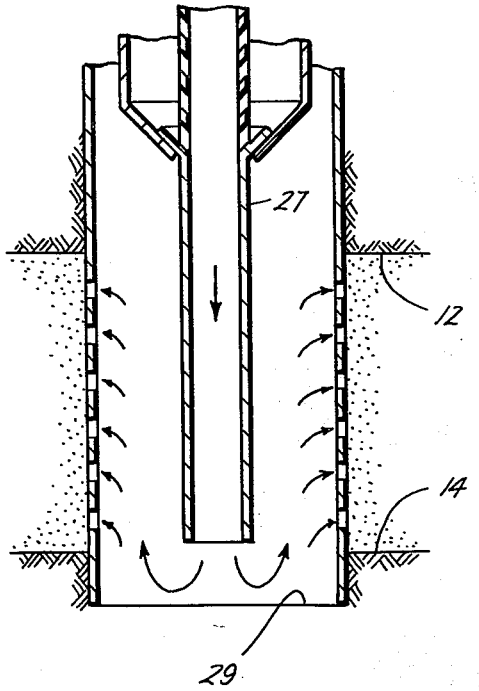
FIG. 3 is a modification utilizing the well bottom as the fluid flow reverser.

The method of injecting or uniformly distributing the liquid and vaporous phases of steam onto the well walls of a petroliferous reservoir comprises the steps of (1) ejecting steam from a gas fired steam generator 10, FIG. 1, positioned in the well 11 just above the petroliferous reservoir 13, (2) piping the hot steam and products of combustion gas flow from the steam generator 10 down to the bottom 29, FIG. 3, of the well which would be adjacent the bottom 14 of the petroliferous reservoir, and (3) reversing the direction of the hot gas flow with a fluid flow reverser 28 to saturate the reservoir surface back up from the bottom 14 of the reservoir to the top 12 of the reservoir with steam of uniform quality and the products of combustion, the stream thus having improved uniformity of distribution of both liquid and vaporous phases for improved enhanced oil recovery.

In the above method of stream injection, the first step may be expanded further by (1) passing the gas flow from the steam generator 10 through a pipe 27 extending downwardly therefrom for a length equal to substantially the thickness of the petroliferous reservoir 13 for improved enhanced oil recovery.

In the above basic method of steam injection wherein the bottom 14 of the petroliferous reservoir is adjacent to the bottom of the well, the second method steps may be expanded further by (2) reflecting the gas flow from the piping 27 upwardly from the well bottom for saturating the complete reservoir wall surface from the reservoir bottom 14 to the reservoir top 12 with stream of uniform quality and the products of combustion, the steam thus having improved uniformity of distribution of both liquid and vaporous phases for improved enhanced oil recovery.

Figure 4:
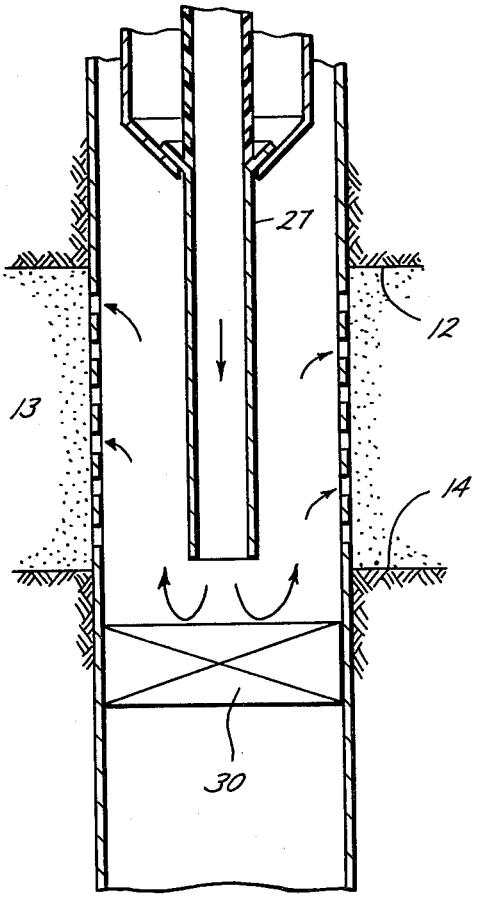
FIG. 4 is another modification utilizing a bridge plug as the fluid flow reverser.

Further in the above basic method of steam injection wherein a bridge plug 30, FIG. 4 is positioned in the well at the bottom 14 of the petroliferous reservoir 13, the second method step may then comprise, (2) reflecting the steam and products of combustion exhaust gas flow from the bridge plug 30 upwardly from the reservoir bottom 14 to the reservoir top 12 for saturating the complete reservoir surface with steam of uniform quality and the products of combustion, the steam thus having improved uniformity of distribution of both liquid and vaporous phases for improved enhanced oil recovery.

Figure 5:
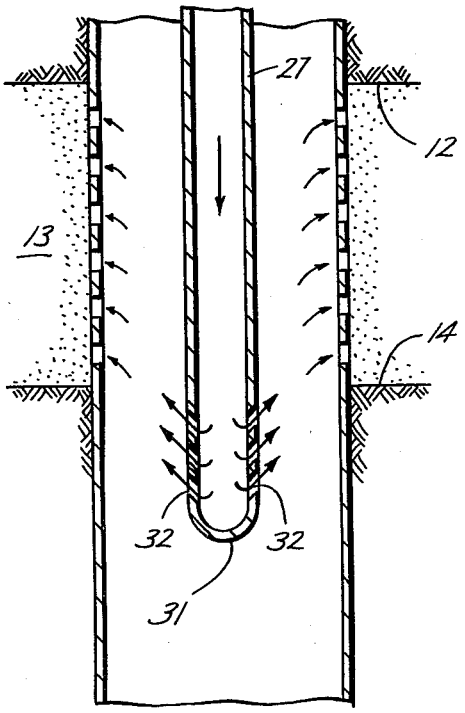
FIG. 5 is a third modification using a reverse flow nozzle as the fluid flow reverser.

Still further in the above basic method of steam injection wherein a fluid flow reverser nozzle 31, FIG. 5, is mounted on the exhaust end of the pipe 27, the second method step may be expanded to comprise further, (2) reflecting the steam and combustion exhaust gas flow upwardly from the fluid flow reverser nozzle for saturating the complete reservoir surface with steam of uniform quality and the products of combustion, the steam thus having improved uniformity of distribution of both liquid and vaporous phases for improved enhanced oil recovery.

THE PREFERRED EMBODIMENT FOR PRACTICING THE INVENTION

The above methods of injecting steam down hole for enhanced oil recovery may be performed by other mechanisms than those disclosed in the FIGURES. The mechanisms disclosed herein may be operated by other methods than those disclosed, as by hand. Also the disclosed mechanism can be used to practice another and materially different method. However, the preferred system for performing the method is disclosed in FIGS. 1–5.

FIG. 1 illustrates a down hole steam generator 10 positioned in a well casing 11 of the top 12 of a petroliferous reservoir 13 for generating a hot exhaust gas flow comprising products of combustion and steam for enhanced oil recovery. The steam generator 10 has a burner combustion chamber 15 supplied by gas from a gas duct 16 supplied by a flexible gas hose 17, air from an air duct **18*a* for forming annulus 18*b* supplied by air supply line 19, and water from water duct 20*a* for forming annulus 20*b* supplied by water supply line 21. A packer 22*a* seals the top of the water duct 20*a* to the well casing 11 for forming the passage 20*b* for the flow of water. The packer 22*a* also isolates and seals the steam generator from the top of the well. Casing head 22*b* receives the gas hose 17, air line 19, and water supply line 21**.

The flexible cable or hose 17 has an electrical harness therein for all electrical control as disclosed in Assignee's prior U.S. Pat. No. 4,137,968 of Feb. 6, 1979.

Gas duct 16, FIG. 1, has precisely sized openings 23 therein for the passage and mixing of the air therein from air annulus **18*b*. This mixture is ignited by ignitor wire 24 for combustion and burning in the combustor 15. Precision formed openings 25 in the lower end of the combustor inject the water therein from the water annulus 20*b* there around for generating steam which then is ejected from a combustor exhaust opening 26 into an elongated pipe 27**.

With the steam generator 10, FIG. 1, positioned at the top, or slightly above, the top of the petroliferous reservoir 13 the elongated pipe 27 is formed of a length of at least substantially equal to or possibly slightly greater than the thickness or the petroliferous reservoir 13. Principally, the packer 22*a* must be located above the petroliferous reservoir. A flow reverser 28 mounted on the bottom of the pipe 27 reverses the exhaust gas flow from the steam generating by substantially 180°. It may be retractable like aircraft thrust reverses, if so desired. Also, both liquid and vapor phases of the steam are well mixed by the sudden 180° reversal of the hot steam flow path for providing simultaneously additional uniformity of both quality of the steam and distribution of both the liquid and vaporous phases of the steam for improved enhanced oil recovery. The cross-sectional area of the opening is preferably twice the cross-sectional area of the pipe 27 for ensuring a minimum of back pressure.

The upper elements of the steam generator as the combustor 15, gas duct 16, flexible hose 17 with the electrical harness therein, and duct 18*a* are similar in structure and operating as fully disclosed in Assignee's prior U.S. Pat. No. 4,137,968 drawn to an automatic burner for insitu combustion in a well.

The new elements added to the above combination to form a new down hole steam generator comprise principally the water supply annulus 20*b* for generating steam and the elongated pipe 27 with fluid flow reverser 28. Without the pipe, as in the conventional steam generator, with both stream liquid and vaporous phases ejected downwardly in the well from the conventional steam generator, the liquid phase with the greatest mass flows straight down to the bottom of the well, if it doesn't evaporate first, while the gaseous phase of the steam whirls around and contacts the walls of the well for heating thereof. But one source of heat, the steam liquid phase, misses the greater portion of the well walls. Inventor's elongated pipe 27 guides all of the steam plus the products of combustion down to the bottom of the petroliferous reservoir. There, the fluid flow reverser 28 reverses or redirects the total flow upwardly against the walls of the petroliferous reservoir formation. Simultaneously with reversing of the fluid flow, the total flow is mixed thoroughly and ejected up to saturate the entire well wall surface and particularly including the wall surface of the petroliferous reservoir up to the packer 22 with the mixture of both liquid and vaporous phases of the steam as well as the products of combustion. Thus, this provides greatly improved uniformily of both distribution and quality of both the liquid and vaporous phases of the steam for improved enhanced oil recovery.

FIG. 3 illustrates an alternative method or substitute fluid flow reverser, if the bottom 14 of the petroliferous reservoir happened to be near the bottom 29 of the well, then the fluid flow reverser 28, FIG. 1, may be removed and the bottom 29, FIG. 3, of the well used as the fluid flow reverser.

Likewise if so desired, a bridge plug 30, as in FIG. 4, may be secured in the well just slightly below the petroliferous reservoir so that upon removal of the fluid flow reverser 28, FIG. 1 the hot exhaust flow from the steam generator is reversed by the bridge plus 30, FIG. 4, and ejected back up the well to saturate all of the petroliferous reservoir wall surfaces.

FIG. 5 illustrates another fluid flow reverser comprising a nozzle plug 31 formed integrally with the lower end of the elongated pipe 27. Upward angled nozzle slots 32 preferably have a total cross-sectional area equal to twice the cross-sectional area of the elongated pipe 27 to ensure a minimum of back pressure. Of course if so desired, this nozzle may be screwed on to the pipe end, or screwed in a collar thereon, or screwed over the end of the pipe, etc.

Briefly in operation of the steam generator of FIG. 1, gas, air, and water are supplied down through their respective ducts 16, 18*b* and 20*b* to the steam generator combustion chamber 15, all positioned with packer 22*a* in the well just above the petroliferous reservoir. Preferably, 80% quality steam is generated and exhausted into the elongated pipe 27 for being guided down to the bottom of the petroliferous reservoir. There fluid flow reverser 28 simultaneously and abruptly mixes and redirects all of the steam liquid and vaporous phases and the products of combustion upwardly to saturate the complete well wall surface from the bottom of the petroliferous reservoir to the top of the reservoir with steam of uniform quality and the products of combustion, the steam thus having improved uniformity of distribution of both liquid and vaporous phases for improved enhanced oil recovery.

Accordingly, it will be seen that the disclosed methods and apparatus for uniformity distributing both liquid and vaporous phases of steam and the products or combustion in a well will operate in a manner which meets each of the objects set forth hereinbefore.

While only a few methods of the invention and a few mechanisms for carrying out the methods have been disclosed, it will be evident that various other methods and modifications are possible in the arrangement and construction of the disclosed steam generator assemblies and methods without departing from the scope of the invention and it is accordingly desired to comprehend within the purview of this invention such modifications as may be considered to fall within the scope of the appended claims.

What is claimed is:

1. A method of injecting steam downhole from a steam generator positioned in a well at the top of a petroliferous reservoir, which comprises the steps of:

(a) positioning a bridge plug in the well at the bottom of the petroliferous reservoir;

(b) piping the hot steam flow from the steam generator down to the bottom of the petroliferous reservoir; and (c) reflecting the hot steam flow upwardly from the bridge plug at the reservoir bottom to the reservoir top for saturating the complete reservoir surface with steam of uniform quality for improved enhanced oil recovery.

2. A method of injecting steam downhole from a steam generator positioned in a well at the top of a petroliferous reservoir, which comprises the steps of:

(a) piping the hot steam flow from the steam generator down to the bottom of the petroliferous reservoir; and (b) reflecting the hot steam flow upwardly with a flow reverser nozzle means for saturating the complete reservoir surface with steam of uniform quality for improved enhanced oil recovery, said flow reverser nozzle means being mounted on the bottom of piping used to carry the hot steam flow to the bottom of the reservoir.

3. A downhole steam generator having fuel, air and water lines for generating steam having both liquid and vaporous phases and positionable in a well at the top of a petroliferous reservoir, comprising:

(a) a combustion chamber means having an exhaust end for ejecting steam;

(b) a pipe means for the exhaust end of said combustion chamber means, said pipe means having a length substantially equal to the thickness of the petroliferous reservoir; and (c) a bridge plug means positionable in the well at the bottom of the petroliferous reservoir for reflecting the steam flow upwardly from the reservoir bottom to the reservoir top for saturating the complete reservoir surface with steam of uniform quality for improved enhanced oil recovery.

4. A downhole steam generator having fuel, air and water lines for generating steam having both liquid and vaporous phases and positionable in a well at the top of a petroliferous reservoir, comprising:

(a) a combustion chamber means having an exhaust end for ejecting steam;

(b) a pipe means for the exhaust end of said combustion chamber means, said pipe means having a length substantially equal to the thickness to the petroliferous reservoir; and (c) a flow reversing nozzle means mounted on the bottom of said pipe means for reflecting the steam flow upwardly from the flow reversing nozzle means to the reservoir top for saturating the complete reservoir surface with steam of uniform quality for improved enhanced oil recovery.

* * * * *